United States Patent [19]

Forschirm

[11] 4,023,927

[45] May 17, 1977

[54] TEXTILE CLEANING PROCESS

[75] Inventor: Alex S. Forschirm, Lake Hiawatha, N.J.

[73] Assignee: Celanese Corporation, New York, N.Y.

[22] Filed: May 8, 1975

[21] Appl. No.: 575,817

[52] U.S. Cl. ..... 8/137; 8/142; 427/242; 427/353

[51] Int. Cl.[2] ..... B08B 3/04

[58] Field of Search ..... 8/142, 137; 252/170, 252/171, DIG. 15; 427/384, 445, 353

[56] References Cited

UNITED STATES PATENTS

| | | | |
|---|---|---|---|
| 3,091,508 | 5/1963 | Edwards | 252/171 |
| 3,473,175 | 10/1969 | Sieber | 8/158 |
| 3,668,000 | 6/1972 | Forshirm | 427/445 |
| 3,707,508 | 12/1972 | Blomfield | 8/142 |
| 3,715,186 | 2/1963 | Anninos | 8/142 |
| R28,014 | 5/1974 | Knieriem | 252/170 |

FOREIGN PATENTS OR APPLICATIONS

| | | | |
|---|---|---|---|
| 1,314,897 | 4/1973 | United Kingdom | 252/DIG. 15 |

OTHER PUBLICATIONS

Reeves, W. A. et al. "American Dyestuff Reporter," vol. 57, No. 26, pp. 35–38, 12/16/68.

Blanc, R. B. "American Dyestuff Reporter," Aug. 1967, p. 32.

Farber, H. A. et al., "American Dyestuff Reporter," Nov. 1968, p. 53.

Whistler, R. L., ed. Industrial Gums, Academic Press, N. Y., 1973, p. 643, (Greminger, G. K. et al.).

Mark, H. et al., ed., Chemical Aftertreatment of Textiles, Wiley–Interscience, N.Y., 1971, pp. 494–497, (Nuessle).

*Primary Examiner*—Paul R. Michl

[57] ABSTRACT

A dry cleaning process is provided which is effective for preventing wet-soil redeposition and improving stain-release characteristics of polyester textile material. The process advantages are accomplished by a dry cleaning solvent system contaning hydroxypropyl methyl cellulose as an anti-soiling agent.

5 Claims, No Drawings

TEXTILE CLEANING PROCESS

BACKGROUND OF THE INVENTION

Wet-soil redeposition has been recognized as a major source of soiling for a number of years. In simplified terms this phenomenon is the spreading-out of localized soil over the entire area of a textile product being cleaned or as sometimes happens the transfer of soil from a heavily soiled product onto a lightly soiled product during cleaning. There are certain generally accepted theories as to how redeposition occurs during laundering.

When soiled articles are placed in a laundry machine with water and detergent, theoretically the soil is removed from the fabrics and dispersed by the detergent. The degree of soil removal from the fabric is dependent upon many factors, including water temperature, type and amount of soil, type and amount of detergent, and the chemical composition of the textile fibers being laundered. If the detergent present in the wash water is not functioning with the proper degree of efficiency, all of the soil will not be held in dispersion. In practical terms, this results in what can be described as a three-way equilibrium between soil remaining on the surface of the fabric, soil dispersed by the detergent and soil which is mechanically suspended in the wash water by the agitation forces of the laundry equipment. The laundry machine represents a dynamic system; this results in a general re-distribution of the soil not held in dispersion over the surfaces of the fabric in the wash load.

In an effort to overcome wet-soil redeposition, and especially wet-soil redeposition on cotton fiber containing fabrics, the detergent industry has incorporated certain additives such as for instance sodiumcarboxymethyl cellulose. Redeposition of soil in the detergent process consists essentially of the deposition of dispersed particulate soil which may be considered to be in a colloidal state onto a fabric in a detergent liquor. Colloidal properties arise from a large value for the ratio of surface area to mass, although this does not, of course, extend to molecular dimensions. Therefore, it is reasonable to consider that the fabric, with its very irregular surface and consequently large surface area, should also exhibit colloidal behaviour in a detergent bath. On the basis of the above assumption, soil redeposition may be considered as being equivalent to the coagulation of the colloidal dispersion and colloid stability theory therefore should be applicable. The system consisting of dispersed soil and fabric detergent liquor may be treated as a colloidal system. Colloid stability or soil redeposition is governed by the result of three component foreces: (1) an electrical force which may be either attractive or repulsive and that is due to a double layer interaction; (2) an attractive force that arises from the dispersion forces, and (3) a non-electrical repulsive force that is due to a non-electrical interaction of the surface adsorption layers of the particles. The ionogenic whiteness retention additives such as the sodium salt of carboxymethyl cellulose functions primarily by increasing the electrical repulsive force as a result of being adsorbed on soil and/or fabric. Carboxymethyl cellulose however, has not been proved to be suitable for incorporation into heavy duty liquid detergent mixtures, nor has carboxymethyl cellulose completely solved the soil redeposition problem in polyester fiber containing fabrics.

An increasing number of wearing apparel and other textile materials are fashioned from fabrics which are formed from synthetic fibers and from snythetic fiber/-natural fiber blends. These textile materials are capable of being cleaned both by wet laundering and dry cleaning procedures.

In a conventional process of dry cleaning fabrics, the soiled fabrics are agitated in a volatile organic dry cleaning solvent which is relatively immiscible with water. Such solvents are generally effective for the removal of grease and oil stains as well as dust, dirt, lint and the like which commonly adhere to the fabrics and to the grease and oil thereon. The agitation is generally accomplished by inserting the fabrics into a perforated cylinder which is rotated in the solvent bath. The solvent is usually circulated by means of a pump through a filter which removes suspended soil particles. By means of recycling and filtering, the solvent can generally be reused many times, and after becoming badly contaminated, can be distilled and used again. After sufficient treatment, the fabrics are usually subjected to centrifugal action to remove excess solvent and then placed in a rotating cylinder or drying cabinet wherein final traces of solvent are removed by a current of warm air.

As a recent development, such as in the cleaning of work clothes, it is becoming common practice to first conduct a conventional dry cleaning procedure, and follow this by a conventional wet laundering procedure.

Heretofore there has not been considered the development of a dry cleaning system which would effectively dry clean textile material and concomitantly impart to the textile materials anti-soiling properties which in subsequent wet laundering procedures would act to prevent wet-soil redeposition and improve stain-release characteristics of the laundered textile materials.

Accordingly, it is an object of the present invention to provide an improved dry cleaning solvent system.

It is another object of the present invention to provide a process for improving the anti-soil characteristics of textile materials.

It is a further object of the present invention to provide a method of treating textile materials so as to prevent wet-soil redeposition and improve stain-release properties when the textile materials are subjected to repeated wet laundering.

Other objects and advantages shall become apparent by the following description and example.

DESCRIPTION OF THE INVENTION

One or more objects of the present invention are accomplished by the provision of a process which comprises incorporating hydroxypropyl methyl cellulose into polyester textile material by contacting the said textile material with a dry cleaning solvent containing between about $10^{-7}$ and 1.0 weight percent hydroxypropyl methyl cellulose and between about 0.1 and 1.5 weight percent water, prior to the time said textile material is wet laundered. In the process of this invention, from about 0.0001 to about 10 percent (by weight of polyester fiber in the textile material) of hydroxypropyl methyl cellulose is incorporated into a polyester textile material; although it is preferred to incorporate from about 0.1 to about 2 percent of hydroxypropyl methyl cellulose into said textile material, and it is most preferred to incorporate from about 0.5 to about 1.5 percent of said additive into the textile material. The polyester textile material used in the process of this invention is comprised of from about 20 to about 100 percent (by weight) of linear synthetic polyester, i.e., polyester prepared from terephthalic acid or its dialkyl ester and a polymethylene glycol of the formula $HO(CH_2)_nOH$ wherein $n$ is an integer of from 2 to about 8. It is preferred that said textile material be comprised of at least 50 weight percent of said polyester and that $n$ be from 2 to 4. In the most preferred embodiment, when $n$ is poly(ethylene terephthlate) is used in the process of this invention.

In the process of this invention, hydroxypropyl methyl cellulose is applied to the textile material prior to the time said textile material is laundered. Unlike other various water soluble polymers, it affords durable anti-soil protection to the treated textile material.

The basic structure for hydroxypropyl methyl cellulose may be shown according to the following formula wherein $n$ is a finite number:

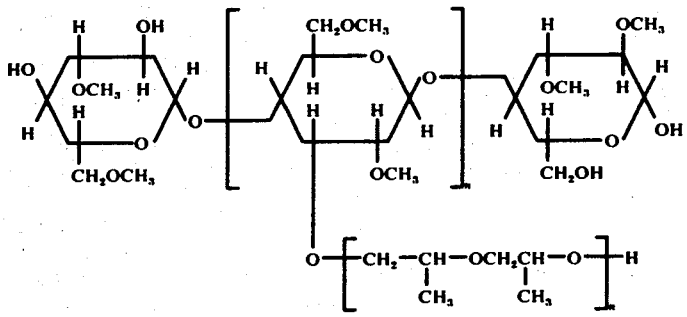

Hydroxypropyl methyl cellulose may be prepared by swelling cotton linters or wood pulp with a caustic soda solution to produce alkali cellulose which is treated with methyl chloride and propylene oxide yielding cellulose ether with varying ratios of propylene glycol ether substitution to methoxy substitution on the anhydroglucose units.

It is an essential feature of the present invention dry cleaning process that the solvent system contain between about 0.1 and 1.5 weight percent water based on the weight of solvent. Effective incorporation of hydroxypropyl methyl cellulose into the polyester textile material cannot be accomplished without the presence of water in the dry cleaning solvent system of the invention process.

Solvents commonly employed in dry cleaning systems include saturated aliphatic hydrocarbons such as ligroin, gasoline, Stoddard solvent, or other low-boiling paraffin hydrocarbons and mixtures thereof; benzene, toluene, xylene, and other low-boiling aromatic hydrocarbons or mixtures thereof; and particularly, low-boiling polyhalogenated hydrocarbons of 1–2 carbon atoms such as carbon tetrachloride, methylchloroform, ethylene dichloride, trichloroethylene, perchloroethylene, trichlorofluoromethane, dichlorotrifluoroethane, trichlorodifluoroethane, and mixtures of these.

In one embodiment of the present invention, the process is employed to dry clean textile materials and at the same time to impart anti-soiling properties to the textile materials. The invention process facilitates the maintenance of textile materials in a condition closely approximating the characteristics of the textile material when new.

In another embodiment of the present invention, the textile materials are first dry cleaned with a conventional solvent system in a first cycle, then the solvent is removed and the clean textile materials are contacted with the present invention solvent system in a second cycle.

The following example is illustrative of the present invention. As it is apparent to those skilled in the art, in the light of the foregoing disclosure numerous modifications are possible in the practice of this invention without departing from the scope or concept thereof.

EXAMPLE

This example illustrates the dry cleaning and anti-soiling treatment of heavily soiled industrial garments by means of a multi-step dry cleaning process applicable for use in conventional industrial dry cleaning equipment.

The dry cleaning step is conducted in accordance with the procedure disclosed in U.S. Pat. No. 3,640,881.

Thirty pounds of white work uniforms of 65 percent polyester/35 percent cotton fiber content heavily soiled with dirt, grease, oil and perspiration are placed in a conventional rotatable dry cleaning basket of standard construction containing 40 gallons of perchloroethylene. Utilizing conventional injection dry cleaning equipment, 24 ounces of the 2 percent optical brightener solution and 12 ounces of Emerbrite 7515 amphoteric detergent available from Emery Industries. Inc., are charged to the cleaning vessel over a period of 2–4 minutes. After 7 minutes of cleaning time have elapsed the cleaning system is charged to the still to separate water and distillable organic contaminates from the perchloroethylene and the garments are centrifuged to a wet weight of about 60 pounds. Following the centrifugation step, 40 gallons perchloroethylene containing 12 ounces of Emerbrite 3723 non-ionic detergent, also available from Emery Industries, Inc., is charged to the cleaning vessel and the garments are treated in a second cleaning cycle for an additional seven minutes with the solvent being continuously filtered for removal of insoluble soils from the system. With the completion of the second cleaning cycle, solvent is discharged and the garments are centrifuged to a weight of about 45 pounds.

In an anti-soiling treatment step, the garments are immersed in 40 gallons of perchloroethylene which contains $10^{-5}$ weight percent hydroxypropyl methyl cellulose (Methocel 228, Dow) and 0.5 weight percent water. The treated garments are centrifuged, the residual solvent is evaporated, and the garments are aerated and dried. The garments exhibit durable anti-soil properties when subjected to repeated wet launderings.

If the foregoing procedures are repeated with 100 percent polyester fabrics, similar results are obtained. The anti-soil properties imparted by hydroxypropyl methyl cellulose are unique. Hence, the incorporation of a water soluble polymer other than hydroxypropyl methyl cellulose into 100 percent polyester fabrics does not provide the same degree of anti-soil protection. For example, each of the following water soluble polymers are each substituted for hydroxypropyl methyl cellulose on a comparison test basis:

polyacrylic acid
polyvinyl alcohol
polyethylene oxide
ethylene-maleic anhydride copolymers
methyl vinyl ether-maleic anhydride copolymer
poly acrylamide
hydroxyethyl ethyl cellulose Each of these materials affords some degree of anti-soil protection to the treated fabric but, in each instance, the protection is completly lost after only one laundering. After five launderings, the fabric treated with hydroxypropyl methyl cellulose still exhibits anti-soiling properties. Other fabrics such as nylon, acrylic, cellulose triacetate, and the like, also have anti-soil properties imparted to them by the incorporating of hydroxypropyl methyl cellulose.

The present invention concept of a combination of dry cleaning and wet laundering techniques is particularly significant in view of a recent innovative trend in the industry to textile cleaning procedures which involve successive dry cleaning and wet laundering steps in the same machine. The combination of dry cleaning and wet laundering steps yields superior results than obtained heretofore in the art of textile cleaning.

As it is apparent, wool-containing fabrics can be treated in accordance with the present invention process and exhibit anti-soiling properties in subsequent cold-water laundering procedures.

What is claimed is:

1. A process for preventing wet-soil redeposition and improving stain-release characteristics of polyester textile material which comprises incorporating into the polyester textile material between about 0.0001 and 10 weight percent of hydroxypropyl methyl cellulose based on the weight of polyester fiber in the textile material, by contacting the said textile material with a dry cleaning solvent containing between about $10^{-7}$ and 1.0 weight percent hydroxypropyl methyl cellulose and between about 0.1 and 1.5 weight percent water, based on the total weight of dry cleaning solvent, prior to the time said textile material is wet laundered.

2. A process in accordance with claim 1 wherein between about 0.1 and 2 weight percent hydroxypropyl methyl cellulose is incorporated into the polyester textile material, based on the weight of polyester fiber in the textile material.

3. A process in accordance with claim 1 wherein the polyester textile material is poly(ethylene terephthalate).

4. A process in accordance with claim 1 wherein the dry cleaning solvent is perchloroethylene.

5. A textile cleaning process which comprises in a first step treating the textile material with a dry cleaning solvent in accordance with the process of claim 1, and in a second step subjecting the dry cleaned textile material to a wet laundering cycle.

* * * * *